US006077639A

United States Patent [19]

Semura et al.

[11] Patent Number: 6,077,639

[45] Date of Patent: Jun. 20, 2000

[54] TONER FOR ELECTROPHOTOGRAPHY

[75] Inventors: Tetsuhiro Semura; Yoshihiro Ueno, both of Wakayama, Japan

[73] Assignee: Kao Corporation, Tokyo, Japan

[21] Appl. No.: 09/455,790

[22] Filed: Dec. 7, 1999

[30] Foreign Application Priority Data

Dec. 7, 1998 [JP] Japan ..... 10-347534

[51] Int. Cl.[7] ..... G03G 9/087

[52] U.S. Cl. ..... 430/109; 430/111

[58] Field of Search ..... 430/109, 111

[56] References Cited

U.S. PATENT DOCUMENTS

| | | | |
|---|---|---|---|
| 5,250,996 | 10/1993 | Sugizaki et al. | 430/109 |
| 5,252,420 | 10/1993 | Tanaka et al. | 430/109 |
| 5,294,682 | 3/1994 | Fukuda et al. | 430/109 |
| 5,342,722 | 8/1994 | Ito et al. | 430/111 |
| 5,618,648 | 4/1997 | Horikoshi et al. | 430/109 |
| 5,707,769 | 1/1998 | Hagi et al. | 430/109 |
| 5,804,347 | 9/1998 | Inoue et al. | 430/111 |
| 5,858,596 | 1/1999 | Tajima et al. | 430/111 |
| 5,958,641 | 9/1999 | Sano et al. | 430/109 |
| 6,007,958 | 12/1999 | Ito et al. | 430/109 |

FOREIGN PATENT DOCUMENTS

| | | |
|---|---|---|
| 57373-53 | 1/1982 | Japan . |
| 470670-0 | 3/1992 | Japan . |
| 10104-878 | 4/1998 | Japan . |

*Primary Examiner*—Roland Martin

[57] ABSTRACT

A toner for electrophotography comprising a resin binder comprising a polyester resin, as a main component, obtained by polycondensing an alcohol component with a carboxylic acid component, wherein the alcohol component comprises an alkylene oxide adduct of bisphenol A represented by the formula (I):

(I)

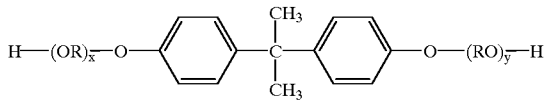

wherein R is an alkylene group having 2 or 3 carbon atoms; x and y are positive numbers showing an average molar number of an added oxyalkylene group, wherein a sum of x and y is from 1.5 to 10, in an amount of 60% by mol or more of the alcohol component, and wherein the carboxylic acid component comprises a tricarboxylic acid compound, wherein a number-average molecular weight of the polyester resin is 1,000 to 8,000; and a coloring agent, wherein an alkylene oxide adduct of bisphenol A of which addition molar number is 3 or more is not present in the polyester resin, or remains in an amount of less than 1.0% by weight.

6 Claims, No Drawings

TONER FOR ELECTROPHOTOGRAPHY

BACKGROUND OF THE INVENTION

1. Field of the Invention

The present invention relates to a toner for electrophotography used for development of electrostatic latent images which are formed in electrophotography, electrostatic recording method, electrostatic printing method, or the like.

2. Discussion of the Related Art

Owing to the cost reduction and the miniaturization of the full color copy machines, oilless fixing devices have been increasingly used, and at the same time, a toner having excellent fixing ability, offset resistance and environmental stability suitably used in the above oilless fixing devices is required. In the case of color toners, the transparency is particularly required. In order to meet this requirement, however, the offset resistance and the storage stability tend to be lowered.

In order to increase the offset resistance of the toner, there has been known a toner comprising a resin binder prepared from a tricarboxylic or higher polycarboxylic acid (Japanese Patent Laid-Open No. Sho 57-37353). However, its storage stability is yet to be insufficient. In addition, there has also been known a toner positively including an alkylene oxide adduct of bisphenol A (Japanese Patent Laid-Open No. Hei 4-70670). However, in a color toner comprising a resin binder having a low molecular weight, the storage stability is not sufficiently improved.

An object of the present invention is to provide a toner for electrography having excellent storage stability, offset resistance, and environmental stability as well as transparency and fixing ability.

The above object and other objects of the present invention will be apparent from the following description.

SUMMARY OF THE INVENTION

In sum, the present invention pertains to a toner for electrophotography comprising:

a resin binder comprising a polyester resin, as a main component, obtained by polycondensing an alcohol component with a carboxylic acid component, wherein the alcohol component comprises an alkylene oxide adduct of bisphenol A represented by the formula (I):

(I)

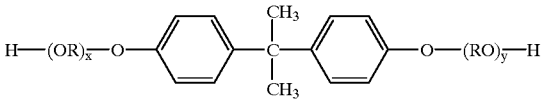

wherein R is an alkylene group having 2 or 3 carbon atoms; x and y are positive numbers showing an average molar number of an added oxyalkylene group, wherein a sum of x and y is from 1.5 to 10, in an amount of 60% by mol or more of the alcohol component, and wherein the carboxylic acid component comprises a tricarboxylic acid compound, wherein a number-average molecular weight of the polyester resin is 1,000 to 8,000; and a coloring agent, wherein an alkylene oxide adduct of bisphenol A of which addition molar number is 3 or more is not present in the polyester resin, or remains in an amount of less than 1.0% by weight.

DETAILED DESCRIPTION OF THE INVENTION

The resin binder used in the toner of the present invention comprises a polyester resin as a main component. The content of the polyester resin in the resin binder is preferably from 60 to 100% by weight, more preferably from 80 to 100% by weight, still more preferably 100% by weight, from the viewpoints of the transparency and the fixing ability. Incidentally, resins which can be used other than the polyester resin in the resin binder include styrene-acrylic resins, epoxy resins and the like.

The polyester resin is obtained by polycondensing an alcohol component with a carboxylic acid component, wherein the alcohol component comprises an alkylene oxide adduct of bisphenol A (hereinafter simply referred to as "BPA-AO") represented by the formula (I):

(I)

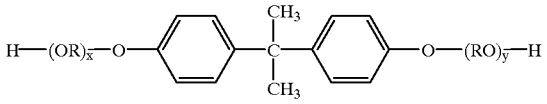

wherein R is an alkylene group having 2 or 3 carbon atoms; x and y are positive numbers showing an average molar number of an added oxyalkylene group, wherein a sum of x and y is from 1.5 to 10, and wherein the carboxylic acid component comprises a tricarboxylic acid compound.

In the present invention, the alcohol component comprises the BPA-AO represented by the formula (I) in an amount of 60% by mol or more, preferably from 80 to 100% by mol of the alcohol component, from the viewpoint of the environmental stability.

The sum of x and y in the formula (I) is from 1.5 to 10, preferably from 1.8 to 5.0.

The BPA-AO represented by the formula (I) includes polyoxypropylene(2.0)-2,2-bis(4-hydroxyphenyl)propane, polyoxyethylene(2.0)-2,2-bis(4-hydroxyphenyl)propane, polyoxypropylene(2.2)-2,2-bis(4-hydroxyphenyl)propane, polyoxyethylene(2.2)-2,2-bis(4-hydroxyphenyl)propane, and the like. It is preferable that one or more kinds of these BPA-AO's are contained in the alcohol component. Incidentally, in the commercial product of the BPA-AO having an average addition molar number of 2.0, the BPA-AO having an addition molar number of 3 or more is contained in an amount of about 4% by weight. In the commercial product of the BPA-AO having an average addition molar number of 2.2, the BPA-AO having an addition molar number of 3 or more is contained in an amount of about 12% by weight. Therefore, in the present invention, in order to control the remaining amount of the BPA-AO having an addition molar number of 3 or more in the polyester resin, it is preferable that a high purity product having a narrow distribution of alkylene oxide of BPA-AO of an average addition molar number of 2.0, such as polyoxypropylene(2.0)-2,2-bis(4-hydroxyphenyl)propane, and polyoxyethylene(2.0)-2,2-bis(4-hydroxyphenyl) propane, is contained in the alcohol component.

In addition, examples of alcohols which can be contained in the alcohol component other than the BPA-AO represented by the formula (I) include dials, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; bisphenol A, hydrogenated bisphenol A, and the like.

The carboxylic acid component comprises a tricarboxylic acid compound in an amount of preferably from 0.1 to 25% by mol, more preferably from 1 to 20% by mol of the carboxylic acid component from the viewpoint of the offset resistance.

The tricarboxylic acid compound includes trimellitic acid, anhydride thereof, an alkyl ester thereof (alkyl moiety having 1 to 8 carbon atoms), and the like.

Further, it is preferable that the carboxylic acid component comprises a dicarboxylic acid compound. The dicarboxylic acid compound includes aliphatic unsaturated dicarboxylic acids, such as maleic acid, fumaric acid, citraconic acid, itaconic acid, glutaconic acid, and n-dodecenylsuccinic acid; aliphatic saturated dicarboxylic acids, such as succinic acid, adipic acid, sebacic acid, azeleic acid, malonic acid, and n-dodecylsuccinic acid; aromatic, dicarboxylic acids such as phthalic acid, isophthalic acid, and terephthalic acid; alicyclic dicarboxylic acids such as cyclohexanedicarboxylic acids; acid anhydrides thereof; and alkyl esters thereof of which alkyl moiety has 1 to 8 carbon atoms.

The polycondensation of the alcohol component with the carboxylic acid component can be carried out by utilizing a known esterification reaction or transesterification reaction. As a general method, for instance, the polycondensation may be carried out by reacting at a reaction temperature of from 170° to 250° C. and a reaction pressure of from 5 mm Hg to normal pressure in an inert gas atmosphere using an appropriate catalyst until a point where a desired softening point is reached. In addition, in the present invention, in order to control the remaining amount of the BPA-AO having an addition molar number of 3 or more in the polyester resin, there may be employed a two-step reaction process comprising (a) polycondensing an alcohol component comprising the BPA-AO represented by the formula (I) with an aromatic, dicarboxylic or higher polycarboxylic acid compound, preferably an aromatic, dicarboxylic acid compound, and (b) adding a dicarboxylic or higher polycarboxylic acid compound, preferably a tricarboxylic acid compound to the resulting reaction mixture obtained in step (a) to carry out further polycondensation therewith. The dicarboxylic or higher polycarboxylic acid compound in step (b) is selected from aliphatic, dicarboxylic or higher polycarboxylic acid compounds and aromatic, dicarboxylic or higher polycarboxylic acid compounds which may be the same or different from that in step (a). It is more desired that the dicarboxylic or higher polycarboxylic acid compound in step (b) comprises an aliphatic, dicarboxylic or higher polycarboxylic acid compound. Since the alcohol component can be sufficiently reacted in step (a), the two-step reaction process described above is a useful method for reducing the amount of the BPA-AO having an addition molar number of 3 or more. The content of the aromatic, dicarboxylic or higher polycarboxylic acid compound used in step (a) is preferably from 20 to 70% by mol, more preferably from 30 to 50% by mol in the carboxylic acid component. The content of the dicarboxylic acid or higher polycarboxylic acid used in step (b) is preferably from 30 to 80% by mol, more preferably from 50 to 70% by mol in the carboxylic acid component. It is desired that the total amount of the tricarboxylic acid compound used in the steps (a) and (b) is adjusted such that the content thereof is from 0.1 to 25% by mol in the carboxylic acid component as described above. In addition, it is desirable that the dicarboxylic or higher polycarboxylic acid compound used in step (b) is added after expending by polycondensation with the alcohol component 60% by mol or more, preferably 80% by mol or more, of the carboxylic acid compound used in step (a).

The number-average molecular weight of the polyester resin in the present invention is from 1,000 to 8,000, preferably from 2,000 to 6,000, from the viewpoints of the transparency, the fixing ability, and the offset resistance. The number-average molecular weight of the polyester resin can be adjusted by the ratio of the carboxylic acid compound to the alcohol, the reaction temperature, the reaction time, and the like.

In addition, the BPA-AO having an addition molar number of 3 or more in the polyester resin is not present, or if it is present, its remaining amount is less than 1.0% by weight, preferably 0.5% by weight or less. Since the remaining amount of the BPA-AO in the polyester resin is controlled to less than 1.0% by weight, the resulting toner has excellent storage stability as well as the transparency and the fixing ability.

The softening point of the polyester resin is preferably 80° to 130° C., more preferably 80° to 115° C.

The glass transition temperature of the polyester resin is preferably 40° to 70° C., more preferably 45° to 70° C.

Examples of the coloring agents in the present invention include dyes and pigments which are used as coloring agents for conventional black toners and color toners. Examples thereof include carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, diazo yellow, and the like. It is preferable that the content of the coloring agent is 2 to 25 parts by weight, based on 100 parts by weight of the resin binder.

In addition, in the toner of the present invention, there may be added in appropriate amounts additive such as a charge control agent, an electrically conductive adjusting agent, an extender, reinforcing fillers such as fibrous materials, an antioxidant, an age resistor, a releasing agent, a fluidity improver, and cleaning improver.

The toner of the present invention can be produced by a known method such as kneading and pulverization method, spray-drying method, and polymerization method. An example of a general method include a method comprising uniformly mixing a resin binder, a coloring agent, a charge control agent, and the like in a mixer such as a ball-mill, thereafter melt-kneading the mixture with a sealed type kneader or a single-screw or double-screw extruder, cooling, pulverizing and classifying the product. Further, a fluidity improver or the like may be added to the surfaces of the toner as occasion demands. The weight-average particle size of the toner of the present invention as prepared above is preferably from 5 to 15 $\mu$m.

The toner for electrophotography of the present invention comprises a polyester resin as a resin binder, herein the polyester resin has a crosslinked structure, and wherein the BPA-AO having an addition molar number of 3 or more in the polyester resin is not present, or if it is present, its remaining amount is small, the BPA-AO presumably being easily liquefied in the polyester resin at room temperature and having high plasticizing effect. Therefore, the toner is excellent not only in the offset resistance but also in the storage stability. Further, the toner for electrophotography of the present invention has high transparency and can form a smooth fixing surface, so that the toner can be particularly favorably used for a color toner.

The toner for electrophotography of the present invention is used as a nonmagnetic one-component developer, or it may be mixed with a carrier to be used as a two-component developer.

EXAMPLES

Softening Point

A temperature at a point where a half of the resin flows out as determined with a koka-type flow tester "CFT-500" (manufactured by Shimadzu Corporation) [sample: 1 g, heating rate: 6° C./min, load: 20 kg/cm$^2$, nozzle: 1 mmΦ×1 mm] is referred to as a softening point.

Glass Transition Temperature

Measured by raising the temperature at a heating rate of 10° C./minute with a differential scanning calorimeter "DSC 210" (manufactured by Seiko Instruments, Inc.).

Number-Average Molecular Weight

Measured in accordance with GPC method [column: GMHLX+G3000HXL (manufactured by Tosoh Corporation), standard sample: monodisperse polystyrene].

Remaining Amount of BPA-AO

In 5 ml of chloroform is dissolved 1 g of the resin. The resulting solution was added to 10 ml of methanol to precipitate the resin. To 0.5 ml of supernatant is added 1 ml of silanizing agent "TMSI-H" (manufactured by G.L. Science K.K.) and dissolved in a hot water bath (500 to 80° C.). Thereafter, the silylation is carried out by well shaking the solution, and the mixture is allowed to stand for separation. The supernatant is quantitatively analyzed by gas chromatography under the following conditions.

Gas Chromatography: GC-7A (manufactured by Shimadzu Corporation)

Liquid Phase: OV17 (manufactured by Nishio Kogyo K.K.)

Concentration: 5% by weight

Carrier gas: helium

Flow rate: 5 mm/min

Detector: Hydrogen Flame Ionization Detector

Flow rate for hydrogen: 0.6 kg/cm$^2$

Flow rate for air: 0.5 kg/cm$^2$

Column temperature: 1000 to 300° C. (heating rate: 3° C./min)

Preparation Example 1

A mixture of 0.5 mol of polyoxypropylene(2.0)-2,2-bis (4-hydroxyphenyl)propane (hereinafter simply referred to as "PO(2.0 mol) adduct") containing propylene oxide adduct of bisphenol A having an addition molar number of 3 or more in an amount of 3% by weight, 0.5 mol of polyoxyethylene (2.0)-2,2-bis(4-hydroxyphenyl)propane (hereinafter simply referred to as "EO(2.0 mol) adduct") containing ethylene oxide adduct of bisphenol A having an addition molar number of 3 or more in an amount of 4% by weight, 0.5 mol of isophthalic acid, 0.1 mol of trimellitic anhydride, and 5 g of dibutyltin oxide was reacted at 230° C. and normal pressure for the first-half of the reaction, and at 200° C. and reduced pressure in the second-half of the reaction in a nitrogen atmosphere, to give Resin A.

Preparation Example 2

A mixture of 0.8 mol of PO(2.0 mol) adduct, 0.2 mol of neopentyl glycol, 0.5 mol of isophthalic acid, 0.4 mol of fumaric acid, 0.1 mol of trimellitic anhydride, and 5 g of dibutyltin oxide was reacted in the same manner as in Preparation Example 1, to give Resin B.

Preparation Example 3

A mixture of 0.7 mol of PO(2.0 mol) adduct, 0.3 mol of EO(2.0 mol) adduct, 0.1 mol of isophthalic acid, 0.7 mol of fumaric acid, 0.2 mol of trimellitic anhydride, and 5 g of dibutyltin oxide was reacted in the same manner as in Preparation Example 1, to give Resin C.

Preparation Example 4

A mixture of 0.6 mol of EO(2.0 mol) adduct, 0.4 mol of ethylene glycol, 0.95 mol of fumaric acid, 0.05 mol of trimellitic anhydride, and 5 g of dibutyltin oxide was reacted in the same manner as in Preparation Example 1, to give Resin D.

Preparation Example 5

A mixture of 0.5 mol of polyoxypropylene(2.2)- 2,2-bis (4-hydroxyphenyl)propane (hereinafter simply referred to as "PO(2.2 mol) adduct") containing propylene oxide adduct of bisphenol A having an addition molar number of 3 or more in an amount of 10% by weight, 0.5 mol of polyoxyethylene (2.2)-2,2-bis(4-hydroxyphenyl)propane (hereinafter simply referred to as "EO(2.2 mol) adduct") containing ethylene oxide adduct of bisphenol A having an addition molar number of 3 or more in an amount of 12% by weight, 0.4 mol of isophthalic acid, and 5 g of dibutyltin oxide was reacted at 230° C. in a nitrogen atmosphere with stirring. At a point where 95% by mol of isophthalic acid was reacted, 0.5 mol of fumaric acid and 0.1 mol of trimellitic anhydride were further added thereto, and the mixture was reacted at 200° C. in a nitrogen atmosphere, to give Resin E.

Preparation Example 6

The same procedures as in Preparation Example 1 were carried out except for using each of 0.5 mol of PO(2.2 mol) adduct and 0.5 mol of EO(2.2 mol) adduct in place of PO(2.0 mol) adduct and EO(2.0 mol) adduct, to give Resin F.

Preparation Example 7

A mixture of 0.1 mol of PO(2.2 mol) adduct, 0.9 mol of EO(2.2 mol) adduct, 0.7 mol of isophthalic acid, 0.4 mol of fumaric acid, and 5 g of dibutyltin oxide was reacted in the same manner as in Preparation Example 1, to give Resin G.

Preparation Example 8

A mixture of 0.9 mol of EO(2.0 mol) adduct, 0.1 mol f ethylene glycol, 0.1 mol of isophthalic acid, 0.9 mol of fumaric acid, 0.05 mol of trimellitic anhydride, and 5 g of dibutyltin oxide was reacted in the same manner as in Preparation Example 1, to give Resin H.

Preparation Example 9

A mixture of 0.5 mol of ethylene glycol, 0.5 mol of neopentyl glycol, 0.6 mol of isophthalic acid, 0.3 mol of fumaric acid, 0.1 mol of trimellitic anhydride, and 5 g of dibutyltin oxide was reacted in the same manner as in Preparation Example 1, to give Resin I.

The softening point, the glass transition temperature, the number-average molecular weight, the remaining amount of BPA-AO having an addition molar number of 3 or more (simply referred to as "Remaining Amount of BPA-AO(3 or more)"), and the remaining amount of BPA-AO having an addition molar number of 2 or less (simply referred to as "Remaining Amount of BPA-AO(2 or less)") for each of Resins A to I are shown in Table 1.

TABLE 1

| | Softening Point (° C.) | Glass Transition Temperature (° C.) | Number-Average Molecular Weight | Remaining Amount of BPA-PO (3 or more) (% by weight) | Remaining Amount of BPA-PO (2 or less) (% by weight) |
|---|---|---|---|---|---|
| Resin A | 95.6 | 52.4 | 2700 | 0.4 | 1.8 |
| Resin B | 100.2 | 54.8 | 3000 | 0.3 | 1.0 |
| Resin C | 94.8 | 55.2 | 2300 | 0.4 | 1.2 |
| Resin D | 115.6 | 64.3 | 5000 | 0.8 | 1.9 |
| Resin E | 97.2 | 52.2 | 2450 | 0.7 | 1.1 |
| Resin F | 95.5 | 49.8 | 2300 | 1.8 | 1.7 |
| Resin G | 105.4 | 61.2 | 3900 | 2.1 | 2.1 |
| Resin H | 118.7 | 65.5 | 10000 | 0.7 | 1.3 |
| Resin I | 110.0 | 57.2 | 5200 | — | — |

Example 1

The materials having the following composition were mixed in a ball-mill, and the mixture was melt-kneaded in a pressure kneader. After cooling the kneaded mixture, the mixture was pulverized and classified, to prepare untreated toner having a weight-average particle size of 8 μm.

| | |
|---|---|
| Resin A | 100 parts by weight |
| C.I. Pigment Red 11 | 5 parts by weight |
| Viscol 550P (manufactured by Sanyo Chemical) | 2 parts by weight |
| LR-147 (manufactured by Nippon Carlit) | 1 part by weight |

To 100 parts by weight of the resulting untreated toner was added 0.3 parts by weight of hydrophobic silica "AEROSIL R-972" (manufactured by Nihon Aerosil) to carry out surface treatment, to give Toner 1.

Examples 2 to 5 and Comparative Examples 1 to 4

The same procedures up to the surface treatment as in Example 1 were carried out except for using each of Resin B, C, D, E, F, G, H or I in place of Resin A, to give each of Toners 2 to 5 and Comparative Toners 1 to 4.

Test Example 1 [Evaluation of Transparency]

A copy of Gazo Denshi Gakkai Chart No. 22. was projected with an OHP, and the spectral transmittance in a wavelength range of from 400 to 700 nm was measured to evaluate transparency according to the following evaluation criteria. The results are shown in Table 2.

Evaluation Criteria

◎: Difference between the maximum and minimum spectral transmittance exceeding 60%.

○: Difference between the maximum and minimum spectral transmittance being from 50 to 60%.

×: Difference between the maximum and minimum spectral transmittance being less than 50%.

Incidentally, when the slidability after fixing the image is poor, the transparency becomes poor. Therefore, it is possible to determine whether or not a slidable fixing surface is obtained from the evaluation of the transparency.

Test Example 2 [Evaluation of Fixing Ability]

An initial fixed image fixed at a fixing rate of 100 mm/sec and a temperature of 180° C. was rubbed backward and forward five times with a sand eraser mounted with a load of 500 g and a bottom area of 15 mm×7.5 mm, and the optical reflective densities before and after eraser treatment were measured by using a reflective densitometer "RD-915" (manufactured by Macbeth Co.). The fixing ability was evaluated according to the following evaluation criteria. The results are shown in Table 2.

Evaluation Criteria

◎: Ratio of the optical reflective densities before and after eraser treatment exceeding 80%.

○: Ratio of the optical reflective densities before and after eraser treatment being from 70 to 80%.

×: Ratio of the optical reflective densities before and after eraser treatment being less than 70%.

Test Example 3 [Evaluation of Storage Stability]

In a cylindrical stainless container having a height of 12 mm and a radius of 30 mm was placed 5.0 g of a toner, and the toner was allowed to stand therein at 50° C. for 72 hours. Thereafter, the toner was sieved with a 30-mesh sieve, and the weight of the toner passing through the sieve was measured. The storage stability was evaluated according to the following evaluation criteria. The results are shown in Table 2.

Evaluation Criteria

◎: Toner passing through the sieve exceeding 90%.

○: Toner passing through the sieve being from 80 to 90%.

×: Toner passing through the sieve being less than 80%.

Test Example 4 [Evaluation of Offset Resistance]

Five parts by weight of a toner and 95 parts by eight of ferrite carriers coated with a silicone resin and having a particle size of 50 μm were mixed with a ball-mill, to prepare a developer. Each of the resulting developer was loaded on "Preter 550" (manufactured by Ricoh) from which the oil applying device was removed to measure the fixable temperature range. The offset resistance was evaluated according to the following evaluation criteria. The results are shown in Table 2.

Evaluation Criteria

◎: Fixable temperature range exceeding 50° C., particularly favorable in practical use.

○: Fixable temperature range being 30° to 50° C., posing no problem in practical use.

×: Fixable temperature range being lower than 30° C., posing problems in practical use.

Test Example 5 [Evaluation of Environmental Stability]

Continuous copying was carried out for 10,000 sheets under each of normal environment (23° C., 50% RH), high-temperature, high-humidity environment (-;5° C., 85% RH), and low-temperature, low-humidity environment (10° C., 15% RH). The triboelectric charge of the toner during continuous copying was measured. The environmental stability was evaluated according to the following evaluation criteria. The results are shown in Table 2.

Evaluation Criteria

◎: Variation in the triboelectric charges being less than 20%, particularly favorable in practical use.

○: Variation in the triboelectric charges being 20 to 30%, posing no problem in practical use.

×: Variation in the triboelectric charges exceeding 30%, posing problems in practical use.

TABLE 2

| | Trans-parency | Fixing Ability | Storage Ability | Offset Resis-tance | Environ-mental Stability |
|---|---|---|---|---|---|
| Toner 1 | ◎ | ◎ | ◎ | ○ | ◎ |
| Toner 2 | ◎ | ◎ | ◎ | ◎ | ○ |
| Toner 3 | ◎ | ◎ | ◎ | ○ | ◎ |
| Toner 4 | ○ | ○ | ◎ | ◎ | ○ |
| Toner 5 | ◎ | ◎ | ○ | ○ | ◎ |
| Comp. Toner 1 | ◎ | ◎ | X | ○ | ◎ |
| Comp. Toner 2 | ○ | ○ | X | X | ◎ |
| Comp Toner 3 | X | X | ○ | ◎ | ◎ |
| Comp. Toner 4 | ○ | ○ | ◎ | ◎ | X |

It is clear from the above results that Toners 1 to 5 are excellent in all of the transparency, the fixing ability, the storage ability, the offset resistance, and the environmental stability, whereas Comparative Toners 1 and 2, where BPA-PO having an addition molar number of 3 or more remains in a large amount in the polyester resin, are deficient in the storage stability, and further Comparative Toner 2, where a resin binder is prepared without using a tricarboxylic acid, is also deficient in the offset resistance. In addition, Comparative Toner 3, where a resin binder has a large number-average molecular weight, has low transparency, deficient in fixing ability. Comparative Toner 4, where BPA-AO is not used in the alcohol component, is deficient in the environmental stability.

According to the present invention, there can be provided a toner for electrophotography having excellent storage stability, offset resistance and environmental stability as well as excellent transparency and fixing ability.

What is claimed is:

1. A toner for electrophotography comprising:

a resin binder comprising a polyester resin, as a main component, obtained by polycondensing an alcohol component with a carboxylic acid component, wherein the alcohol component comprises an alkylene oxide adduct of bisphenol A represented by the formula (I):

(I)

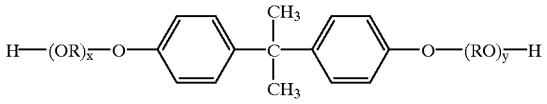

wherein R is an alkylene group having 2 or 3 carbon atoms; x and y are positive numbers showing an average molar number of an added oxyalkylene group, wherein a sum of x and y is from 1.5 to 10, in an amount of 60% by mol or more of the alcohol component, and wherein the carboxylic acid component comprises a tricarboxylic acid compound, wherein a number-average molecular weight of the polyester resin is 1,000 to 8,000; and a coloring agent, wherein an alkylene oxide adduct of bisphenol A of which addition molar number is 3 or more is not present in the polyester resin, or remains in an amount of less than 1.0% by weight.

2. The toner according to claim 1, wherein the tricarboxylic acid compound is contained in an amount of from 0.1 to 25% by mol in the carboxylic acid component.

3. The toner according to claim 1, wherein the polyester resin is prepared by the steps comprising:

(a) polycondensing the alcohol component comprising the alkylene oxide adduct of bisphenol A represented by the formula (I) in an amount of 60% by mol or more of the alcohol component with an aromatic, dicarboxylic or higher polycarboxylic acid compound; and (b) adding a dicarboxylic or higher polycarboxylic acid compound to the resulting reaction mixture obtained in step (a) to carry out further polycondensation therewith.

4. The toner according to claim 3, wherein the dicarboxylic or higher polycarboxylic acid compound in step (b) is selected from aliphatic, dicarboxylic or higher polycarboxylic acid compounds and aromatic, dicarboxylic or higher polycarboxylic acid compounds which may be the same or different from that in step (a).

5. The toner according to claim 4, wherein the dicarboxylic or higher polycarboxylic acid compound in step (b) comprises an aliphatic, dicarboxylic or higher polycarboxylic acid compound.

6. The toner according to claim 1, which is a color toner.

* * * * *